US006965749B2

(12) United States Patent
Lee

(10) Patent No.: US 6,965,749 B2
(45) Date of Patent: Nov. 15, 2005

(54) IMAGE INPUTTING DEVICE WITH ELECTROSTATIC GENERATING DEVICE

(75) Inventor: Shih Yang Lee, Hsin-Chu (TW)

(73) Assignee: Lite-On Technology Corporation, (TW)

( * ) Notice: Subject to any disclaimer, the term of this patent is extended or adjusted under 35 U.S.C. 154(b) by 0 days.

(21) Appl. No.: 10/770,541

(22) Filed: Feb. 2, 2004

(65) Prior Publication Data

US 2005/0169682 A1 Aug. 4, 2005

(51) Int. Cl.[7] ..... G03G 15/00
(52) U.S. Cl. ..... 399/377; 399/380
(58) Field of Search ..... 399/377–380, 399/361, 365, 310, 314–317

(56) References Cited

U.S. PATENT DOCUMENTS 3,634,740 A * 1/1972 Stevko ..... 361/234
4,130,852 A * 12/1978 Peffer et al. ..... 361/213
4,734,789 A * 3/1988 Smith et al. ..... 358/300
6,640,083 B2 * 10/2003 Conard-White et al. .... 399/377
6,668,154 B2 * 12/2003 Dickhoff ..... 399/388
6,734,996 B1 * 5/2004 Lee ..... 358/486

FOREIGN PATENT DOCUMENTS

JP 8-190155 A * 7/1996

* cited by examiner

*Primary Examiner*—Anthony Nguyen
(74) *Attorney, Agent, or Firm*—Squire, Sanders & Dempsey L.L.P.

(57) ABSTRACT

The present invention provides an image-inputting device with an electrostatic generating device used to generate the electrostatic charge to inner surface of the top cover of the image-inputting device, such that the document sheet can be adsorbed by the electrostatic charge that over the inner surface of the top cover after scanning or photocopy process is finished. Thus, the document sheet would fall down to the transparent platen owing to the adsorbability between the document sheet and the inner surface of the top cover of the image-inputting device is disappeared.

23 Claims, 6 Drawing Sheets

IMAGE INPUTTING DEVICE WITH ELECTROSTATIC GENERATING DEVICE

BACKGROUND OF THE INVENTION

1. Field of the Invention

The present invention generally relates to an image-inputting device, and more particularly to a scanning device with an electrostatic generating device.

2. Description of the Prior Art

In typically flat-bed type scanning device, the document sheet is adsorbed on the transparent platen of the image-inputting device when the document sheet is finished scanning or photocopying process, wherein the scanning device can be scanner, photocopier or multi-function peripheral. Due to the scanning or photocopying process would caused the heat to generate the static electricity to adsorb the document sheet on the transparent platen, so that the user cannot easy to take out the documents sheet from the transparent platen.

SUMMARY OF THE INVENTION

It is an object of this invention, is that to provide an electrostatic generating device to generate the electrostatic charge to inner surface of the top cover of the image-inputting device to automatically adsorb the document sheet from the transparent platen.

It is another object of this invention, is that to provide a thin slice under the inner surface of the top cover of the image-inputting device to receive the electrostatic charge from the electrostatic generating device to adsorb the document sheet from the transparent platen.

It is a further object of this invention to provide a computer program to control the electrostatic generating device to generate the electrostatic charge to neutralize the electrostatic charge, which is over the inner surface of the top cover of the image-inputting device. The document sheet is separated from the inner surface of the top cover of the image-inputting device to fall on the transparent platen to take out easy by user, when the adsorbability between the document sheet and the inner surface of the top cover is disappeared.

It is still another object of this invention to provide a button element to control the electrostatic generating device. When the electrostatic charge is over the inner surface of the top cover that is neutralized by the electrostatic generating device to generate another electrostatic charge with another conductivity type to let the adsorbability is disappeared between the document sheet, and the inner surface of the top cover. Thus, the document sheet is separated from the inner surface of the top cover of the image-inputting device.

According to abovementioned objects, the present invention provides a method and a device to convenient to take out the document sheet after scanning or photocopying process is finished. The steps of the method include after scanning or photocopying process is finished, the electrostatic charge is generated and is transferred to the inner surface of the top cover of an image-inputting device, wherein the inner surface is faced to the document sheet; the document sheet is adsorbed by the electrostatic charge from the transparent platen when the top cover is opened; the electrostatic charge with another conductivity type is generated and is transferred to the inner surface of the top cover to neutralize the electrostatic charge which is over the inner surface of the top cover; and the document sheet is separated from the inner surface of the top cover of image-inputting device.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Some sample embodiments of the invention will now be described in greater detail. Nevertheless, it should be recognized that the present invention can be practiced in a wide range of other embodiments besides those explicitly described, and the scope of the present invention is expressly not limited except as specified in the accompanying claims.

According to conventional image-inputting device will cause the electrostatic charge to adsorb the document sheet on the transparent platen, the user cannot easy to take out the document sheet from the transparent platen after scanning or photocopying process is finished. Thus, the present invention provides a method and a device to improve the convenient to take out the document sheet from the transparent platen by using the static electricity to adsorb the document sheet under the inner surface of the top cover after scanning or photocopying process is finished.

Herein, the present invention focuses on the image-inputting device with top cover, thus, the image-inputting devices without the top cover, which is not discussed in the present invention.

Figure 1A:
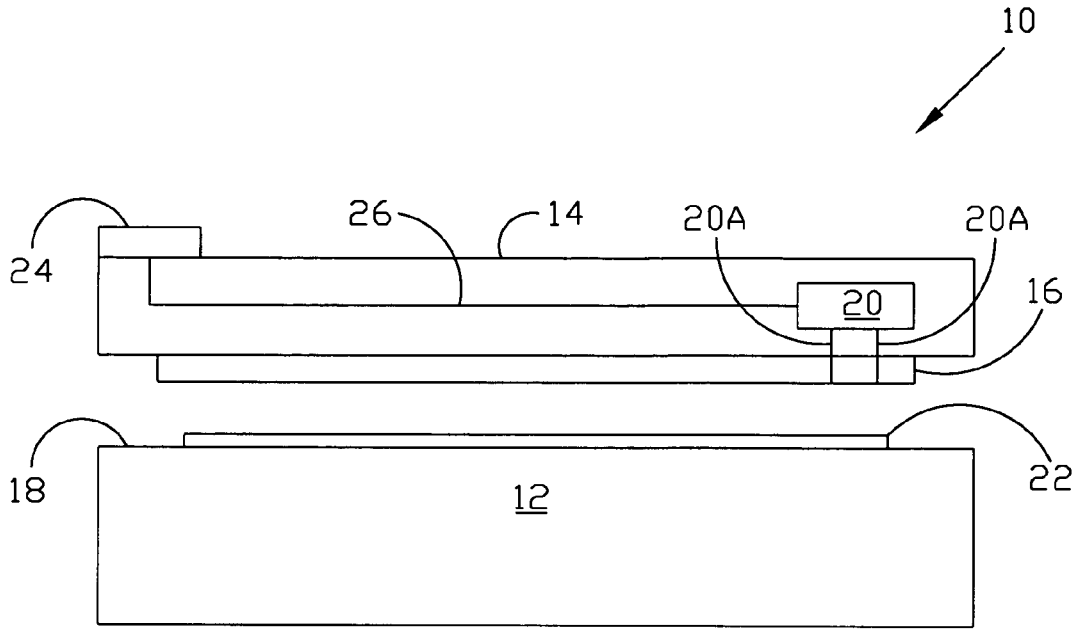
FIG. 1A to FIG. 1D is schematic representations the steps of the document sheet adsorbs by the inner surface of the top image-inputting device with an electrostatic generating device in accordance with a device disclosed herein.
Figure 1B:
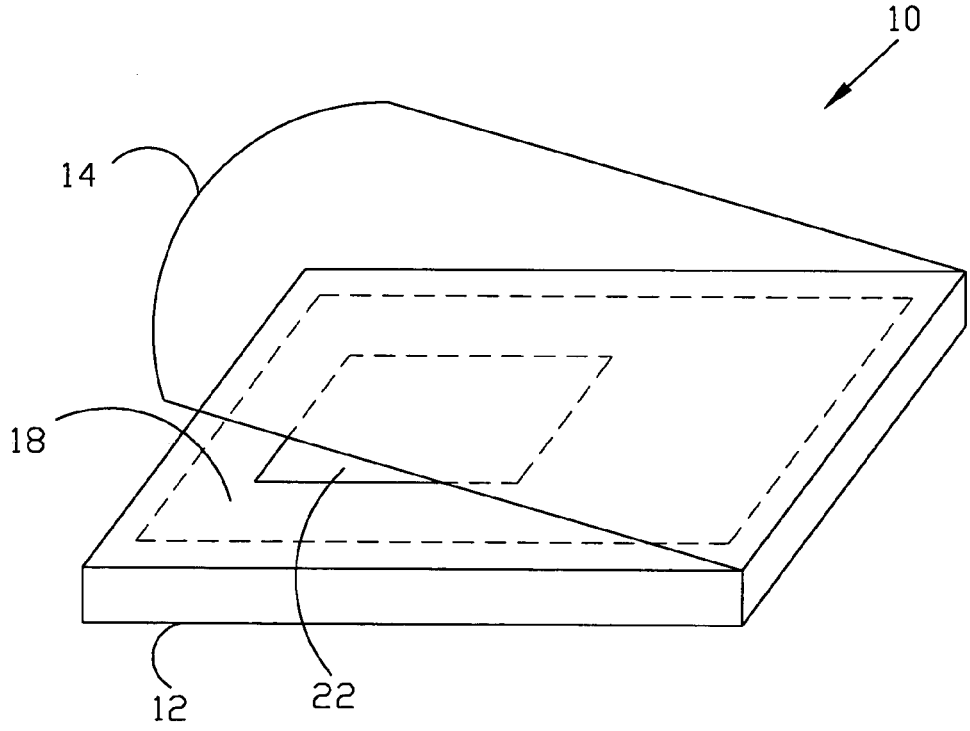

FIG. 1A illustrates the image-inputting device having an electrostatic generating device therein or thereon. The image-inputting device 10 such as flat-type scanning device or photocopier, which includes a top cover 14 having a button element 24 thereon, and the top cover used to cover the transparent platen 18 during scanning process or photocopying process, a transparent platen 18 (as shown in FIG. 1B), on which the opaque document sheet or photographs may be placed face down for scanning or photocopying, and housing 12 of the image-inputting device 10. Herein, the top cover 14 having an inner surface 16 that can be a soft plate, such as the inner surface of the top cover of the photocopier, or can be a hard plate, such as the inner surface of the scanner. The key feature of the present invention is that the electrostatic generating device 20 is integrated with the image-inputting devices 10 to improve the convenience of the image-inputting device, wherein the position of the electrostatic generating device 20 can place on the top cover 14, lateral of the housing 12 of the image-inputting device 10, or within the housing 12 of the image-inputting device 10.

In the present invention, the button element 24 is electrically coupled to the electrostatic generating device 20 through the conductive wire 26, and further the conductive wire 26 is electrically coupled to top cover 14. When the user presses the button element 24, a signal is transferred to the electrostatic generating device 20 through the conductive wire 26 to execute the electrostatic generating device 20 to generate the electrostatic charge. Then, the electrostatic charge is transmitted to the inner surface 16 of the top cover 14 through the electric wire 20A. Alternatively, the button element 24 is an optional element, when the electrostatic generating device 20 is controlled by computer program. The electrostatic charge is generated from the electrostatic generating device 20 to the inner surface 16 of top cover 14 of image-inputting device 10, and the button elements 24 could not be necessary in the present invention. In addition, the button elements 24 can locate on the top cover 14 or on the side of the top cover 14.

When the scanning or photocopying process is finished, the user can press the button element 24 to execute the electrostatic generating device 20 to generate the electrostatic charge. The electrostatic charge is transmitted to the inner surface 16 of the top cover 14 through the electric wire 20A. Therefore, the electrostatic charge is distributed over the inner surface 16 of the top cover 14. Then, the documents sheet 22 can be adsorbed by the electrostatic charge that over the inner surface 16 of the top cover 14.

Figure 1C:
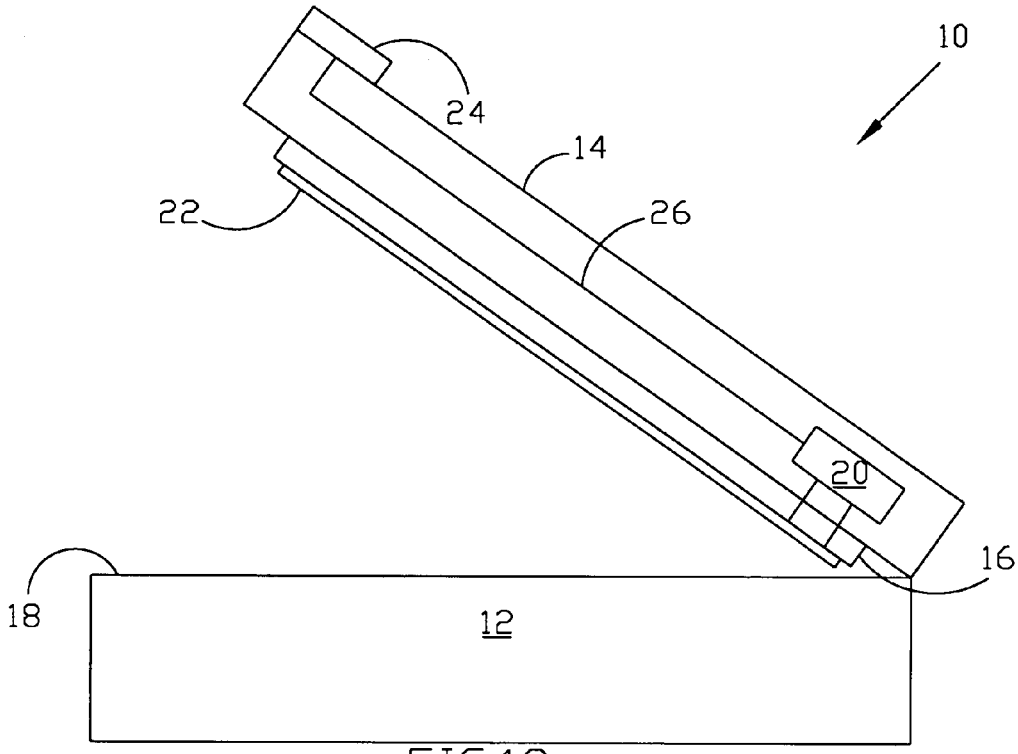

As shown in FIG. 1C, the button element 24 is still pressed when the user lift up the top cover 14. Because the adsorbability between the inner surface 16 of the top cover 14 and document sheet 22 is larger than adsorbability between the document sheet 22 and the transparent platen 18. Thus, the document sheet 22 would be adsorbed under the inner surface 16 of the top cover 14.

Figure 1D:
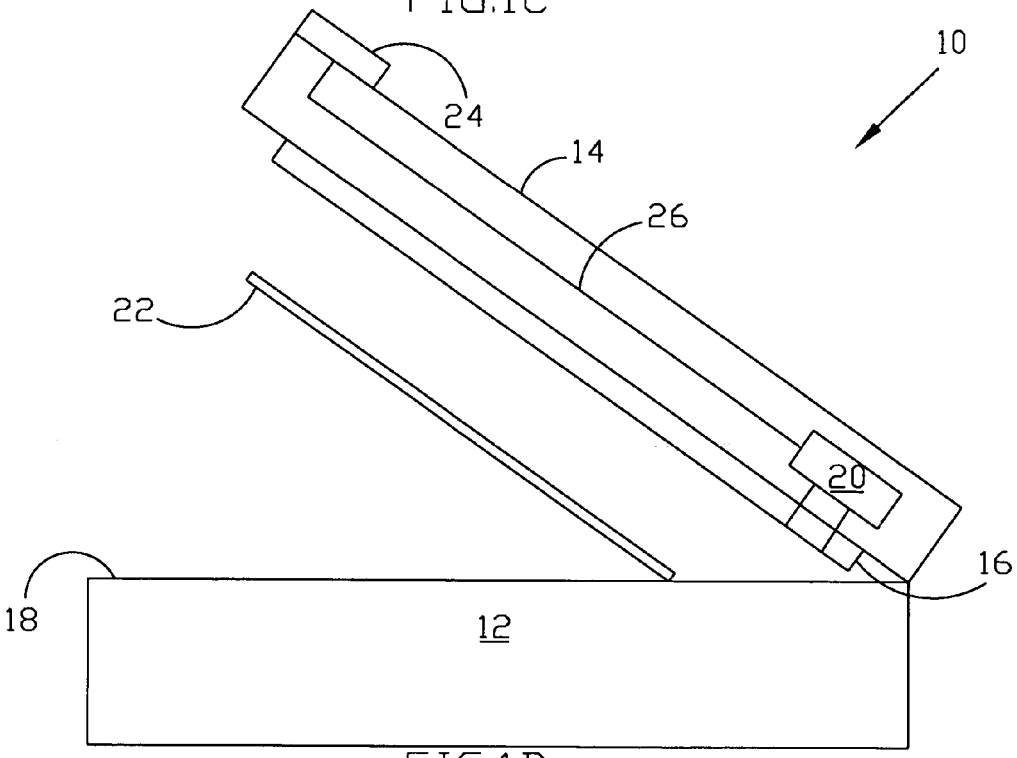

Referring to FIG. 1D, the electrostatic generating device 20 will generate the electrostatic charge with another conductive type to the inner surface 16 through the electric wire 20A, when the user releases the button element 24. At the same time, the signal would be transferred to the electrostatic generating device 20 through the conductive wire 26. At the present, the electrostatic charge over the inner surface 16 of the top cover 14 would be neutralized to make the adsorbability between the document sheet 22 and the inner surface 16 of the top cover 14 is disappeared. Therefore, the document sheet 22 will separate from the inner surface 16 of the top cover 14 to fall on the transparent platen 18. Thus, the user can easily take out the document sheet 22 from the transparent platen 18 of the image-inputting device 10.

Figure 2A:
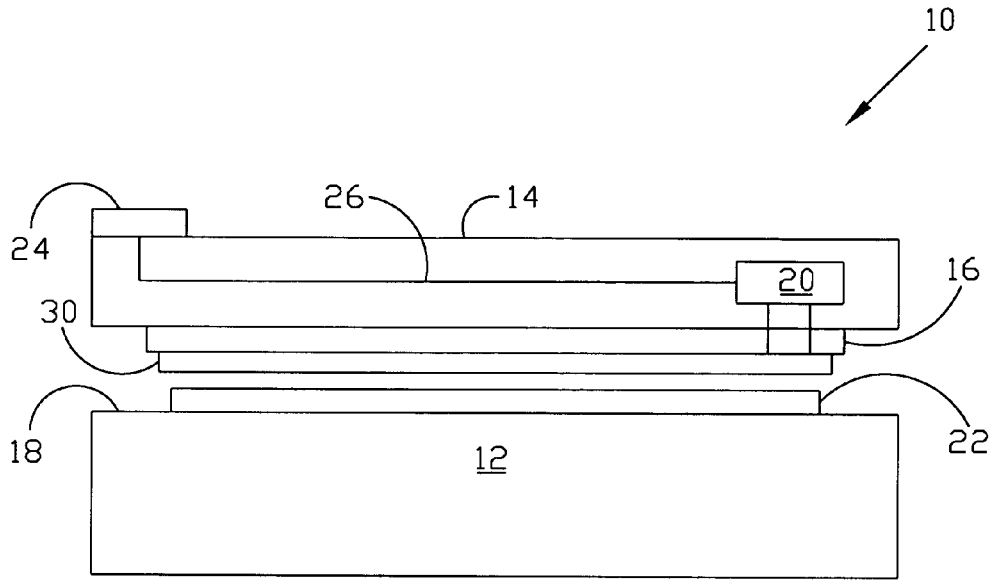
FIG. 2A to FIG. 2C is schematic representations the steps of the document sheet adsorbs by the thin slice which is under the inner surface of the top cover of the image-inputting device in accordance with the device disclosed herein; and FIG. 3A to FIG. 3D is a schematic representation the steps of the document sheet adsorbs by conducting the electrostatic charge to the two metal plates within the top cover of the image-inputting device in accordance with the device disclosed herein.
Figure 2B:
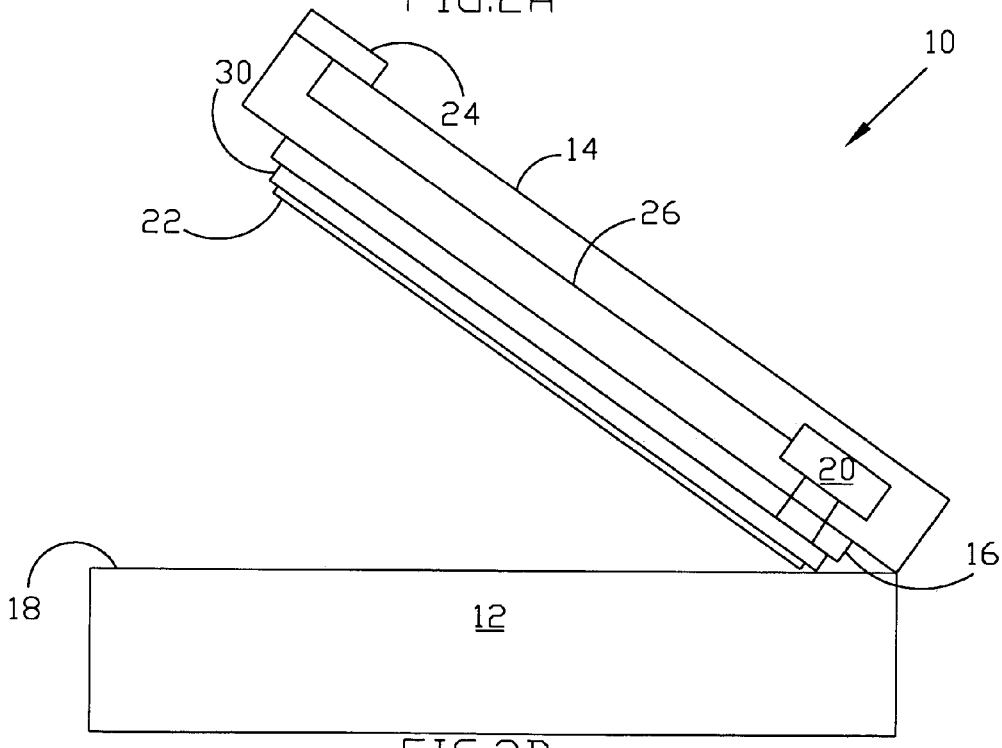
Figure 2C:
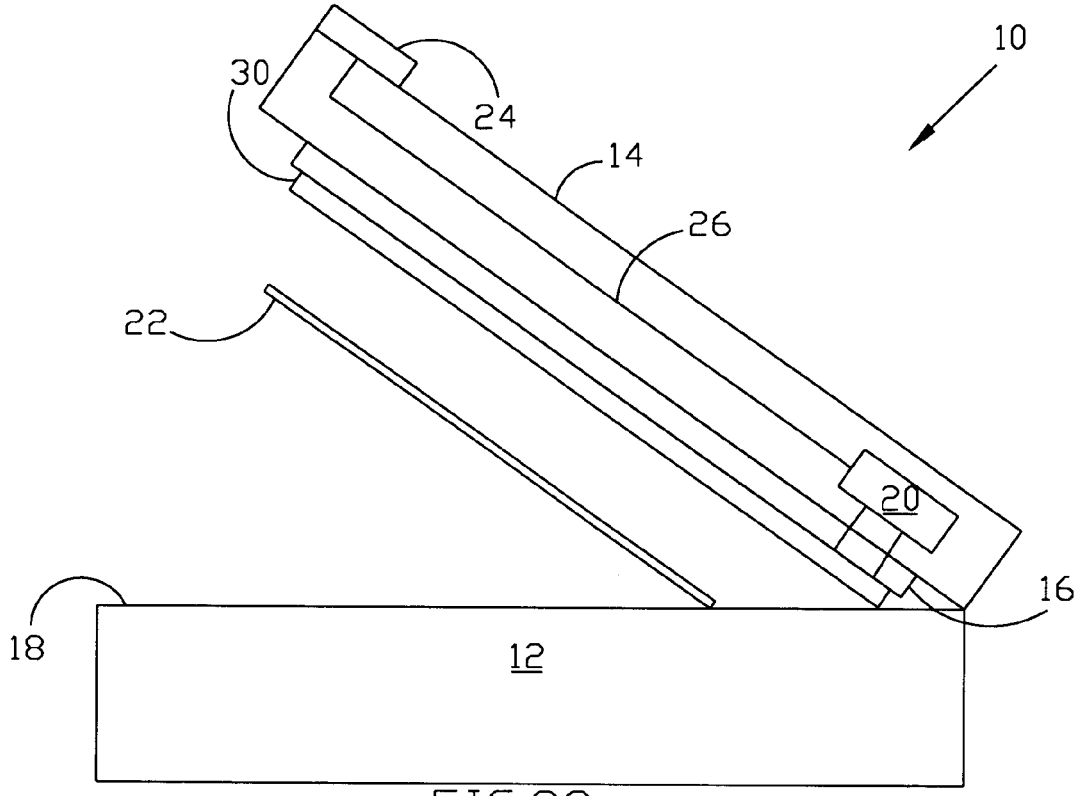

Similarly, as referring to FIG. 2A to FIG. 2C, illustrate another preferable embodiment of the present invention. The image-inputting device 10 includes a thin slice 30 on the inner surface 16 of the top cover 14, which used to receive the electrostatic charge and to spread the electrostatic charge over the inner surface 16 of the top cover 14, which is used to adsorb the document sheet 22 from the transparent platen 18. As the FIG. 2A, after finishing the scanning or photocopying process, the user can press the button element 24 to execute the electrostatic generating device 20 to generate the electrostatic charge. The electrostatic charge is transmitted to the thin slice 30, which is under the inner surface 16 of the top cover 14, so as to make the electrostatic charge spreads over the thin slice 30.

Because of the electrostatic charge spread over the thin slice 30, the document sheet 22 can be adsorbed on the thin slice 30 from the transparent platen 18 by the static electricity (at the present, the adsorbability between the document sheet 22 and the thin slice 30 is larger than the adsorbability between the document sheet 22 and the transparent platen 18). Thus, when user lifts up the top cover 14, the document sheet 22 is adsorbed under the thin slice 30 simultaneously (as shown in FIG. 2B).

Also referring to FIG. 2C, when the user releases the button element 24, the electrostatic charge with another conductivity type would be generated. The electrostatic charge is transmitted from the electrostatic generating device 20 into the thin slice 30 through the electric wire 20A. Therefore, the electrostatic charge spread over the thin slice 30 would be neutralized to make the adsorbability between the document sheet 22 and the thin slice 30 is disappeared. Thus, the document sheet 22 can be separated from the thin slice 30 to fall on the transparent platen 18. Finally, the user can take out the document sheet 22 easily.

Figure 3A:
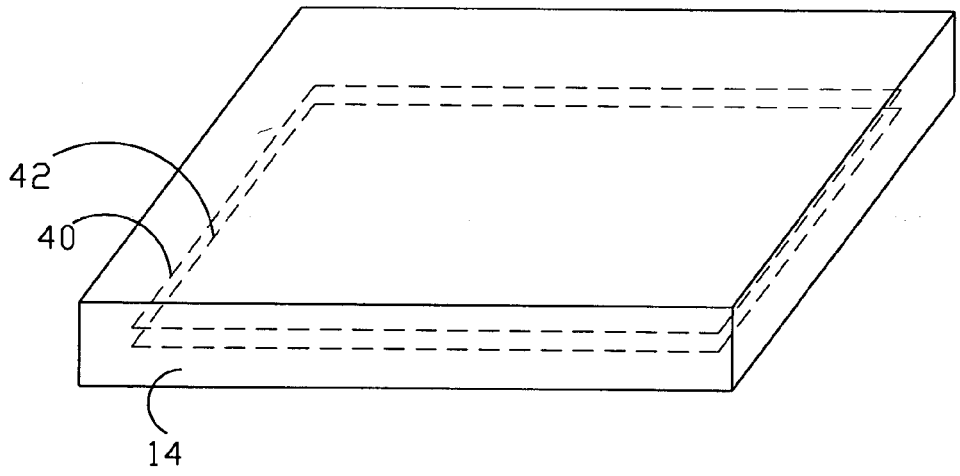

On the other hand, another preferred embodiment of the present invention provides as shown in FIG. 3A to FIG. 3D. FIG. 3A illustrates the top cover 14 having a first metal plate 40 and a second metal plate 42 therein, wherein the distance between the first metal plate 40 and a second metal plate 42 is very short. But the first metal plate 40 and second metal plate 42 is not getting in touch with each other. The first metal plate 40 and second metal plate 42 having a conductive wire 44, 46 that is electrically coupled to the power supplier 48 respectively. The power supply 48 can be D.C (direct current) or A.C (alternating current) which is used to conduct and to generate electrostatic charge having opposite the conductive type that is over the surface to face the first metal plate 40 and the second metal plate 42.

Figure 3B:
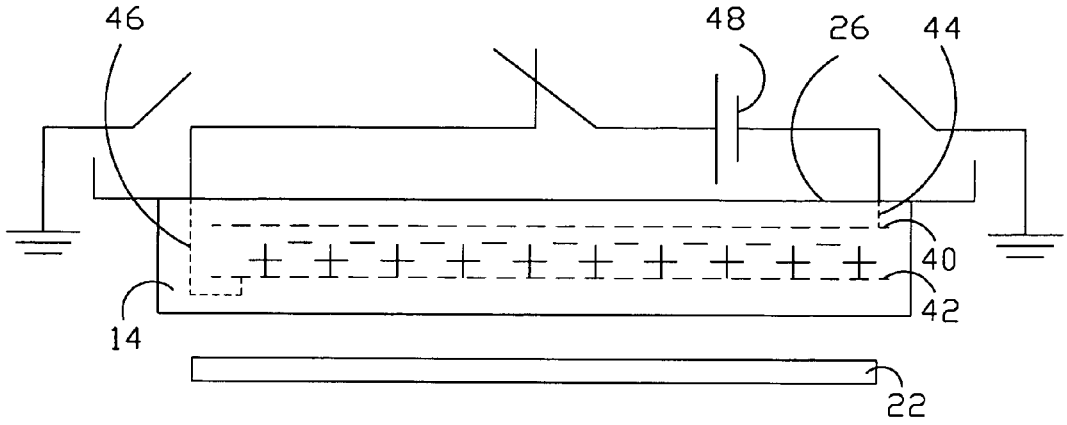

In FIG. 3B, when the power supplier 48 is applied to the first metal plate 40 and the second metal plate 42 respectively. The electrostatic charge having opposite conductivity type that will spread on the inner surface of the first metal plate 40 and second metal plate 42. At this time, the document sheet 22 cannot be adsorbed by the first metal plate 40 or second metal plate 42.

Figure 3C:
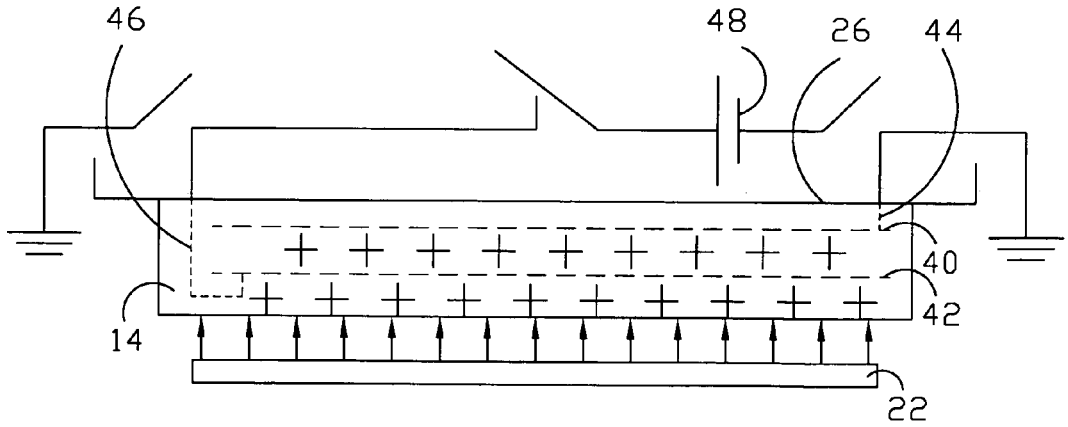

Referring to FIG. 3C, the user can press the button element 24 on the top cover 14 or utilize the computer program to disconnect the connection between the power supplier 48 and the first metal plate 40 and second metal plate 42. Then, the first metal plate 40 is grounded so as to remove the electrostatic charge that is over the first metal plate 40. Thus, the electrostatic charge only remained over the second metal plate 42, wherein the electrostatic charge having unity conductivity type. Therefore, the second metal plate 42 having an adsorbability to adsorb the document sheet 22 from the transparent platen 18, when the adsorbability between the document sheet 22 and the second metal plate 42 is larger than the document sheet 22 and the transparent sheet 18. Thus, the document sheet 22 can easily to adsorb by the second metal plate 42 which has electrostatic charge.

Figure 3D:
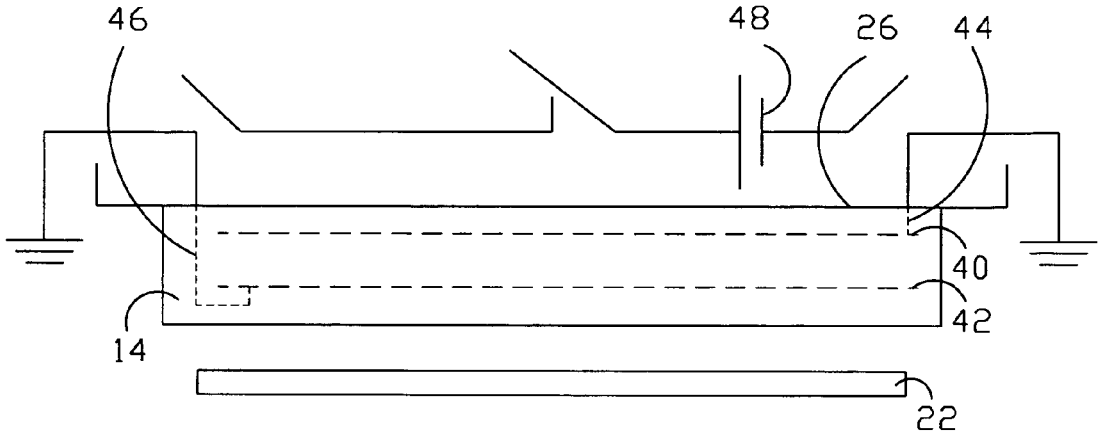

Referring to FIG. 3D, when user lifts up the top cover 14 of the image-inputting device 10, a signal is transmitted to execute the power supplier 48 to disconnect the connection between the power supplier 48 and the second metal plate 42, such that the second metal plate is grounded to remove the electrostatic charge that is over the second metal plate 42. Therefore, the adsorbability between the document sheet 22 and the second metal plate 42 would be disappeared. The document sheet 22 will fall down to the transparent platen 18 to take out easily to user.

According to abovementioned, the present invention provides an image-inputting device with an electrostatic generating device therein or thereon. The electrostatic generating device can improve the convenience for taking out the document sheet from the image-inputting device after scanning or photocopying process. The document sheet could be adsorbed under the inner surface of the top cover by static electricity, and could be separated from the inner surface of the top cover to the transparent platen when the adsorbability between the document sheet and the inner surface of the top cover is disappeared.

Furthermore, the advantage of the present invention is that the user can press the button element on the top cover, or utilize the computer program to control the electrostatic generating device. When the user lifts up the top cover of the image-inputting device, a signal is transmitted into electrostatic generating device to execute to generate the electrostatic charge. The electrostatic charge would transmit to the inner surface of the top cover through the electric wire to neutralize the electrostatic charge that is over the inner surface of the top cover. When the adsorbability is disappeared, the document sheet would be separated from the inner surface of the top cover to fall down. Thus, the user can take out the document easily.

Another advantage of the present invention is that the electrostatic generating device can locate any position, such as on the top cover, lateral of the image-inputting device, or within the housing of the image-inputting device. The position of the electrostatic generating device will not be affected the performance or the function of the image-inputting device.

Although specific embodiments have been illustrated and described, it will be obvious to those skilled in the art that various modifications may be made without departing from what is intended to be limited solely by the appended claims.

What is claimed is:

1. An image-inputting device with an electrostatic generating device, said image-inputting device with said electrostatic generating device comprising:

a button element;

a top cover having a first metal plate and a second metal plate therein;

a housing of an image-inputting device having a transparent platen, wherein said top cover located on said housing of said image-inputting device, and said top cover covered said transparent platen of said image-inputting device; and an electrostatic generating device, electrically coupling to said top cover by a conductive wire.

2. The image-inputting device with said electrostatic generating device according to claim 1, wherein said button element is located on said top cover to control said electrostatic generating device to generate electrostatic charge.

3. The image-inputting device with said electrostatic generating device according to claim 1, wherein said button element is located on the side of said top cover to control said electrostatic generating device to generate electrostatic charge.

4. The image-inputting device with said electrostatic generating device according to claim 1, wherein said electrostatic generating device generates said electrostatic charge, and transmit to a thin slice, which is under said inner surface of the top cover through an electric wire to adsorb said document sheet located on said transparent platen.

5. The image-inputting device with said electrostatic generating device according to claim 1, further comprising a thin slice under an inner surface of said top cover.

6. The image-inputting device with said electrostatic generating device according to claim 1, wherein said electrostatic generating device generates said electrostatic charge, and transmits to a thin slice, which is under said inner surface of the top cover through an electric wire to adsorb said document sheet located on said transparent platen.

7. The image-inputting device with said electrostatic generating device according to claim 1, further comprising a power supplier having at least two conductive wires that are electrically coupling to said first metal plate and said second metal plate respectively.

8. The image-inputting device with said electrostatic generating device according to claim 7, wherein said power supplier for generating said electrostatic charge that having an opposite conductivity type on the faced surface between said first metal plate and said second metal plate.

9. The image-inputting device with said electrostatic generating device according to claim 8, wherein said first metal plate removes said electrostatic charge, and said second metal plate adsorbs said document sheet from said transparent platen.

10. The image-inputting device with said electrostatic generating device according to claim 1, wherein said electrostatic generating device is located on the lateral of said housing of said image-inputting device.

11. The image-inputting device with said electrostatic generating device according to claim 1, wherein said electrostatic generating device is located within said housing of said image-inputting device.

12. An image-inputting device with an electrostatic generating device, said image-inputting device with said electrostatic generating device comprising:

a top cover having a first metal plate and a second metal plate therein, and a button element thereon;

a housing of an image-inputting device having a transparent platen thereon, wherein said top cover covered said transparent platen of said image-inputting device; and an electrostatic generating device electrically coupling to said top cover and said button element.

13. The image-inputting device with said electrostatic generating device according to claim 12, wherein said button element is located on said top cover.

14. The image-inputting device with said electrostatic generating device according to claim 12, wherein said button element controlled said electrostatic generating device to generate the electrostatic charge.

15. The image-inputting device with said electrostatic generating device according to claim 12, further comprising a power supplier having at least two conductive wires to electrically couple said first metal plate, and said second metal plate respectively.

16. The image-inputting device with said electrostatic generating device according to claim 12, wherein said electrostatic generating device generated the electrostatic charge and transmitted said electrostatic charge with opposite conductivity type to said first metal plate, and said second metal plate of said top cover.

17. The image-inputting device with said electrostatic generating device according to claim 16, wherein said first metal plate removed said electrostatic charge, and said second metal plate adsorbs said document sheet from said transparent platen.

18. The image-inputting device with said electrostatic generating device according to claim 12, wherein said electrostatic generating device located on the lateral of said housing of said image-inputting device.

19. The image-inputting device with said electrostatic generating device according to claim 12, wherein said electrostatic generating device located within said housing of said image-inputting device.

20. A method for taking out a document sheet from an image-inputting device, said method comprising:

providing a document sheet on a transparent plate of an image-inputting device;

generating and transmitting an electrostatic charge with a first conductivity type to an inner surface of a top cover;

generating static electricity to said inner surface of said top cover;

adsorbing said document sheet on said transparent platen by using said electrostatic charge with said first conductivity type that spread over said inner surface of said top cover;

generating and transmitting an electrostatic charge with a second conductivity type to said inner surface of said top cover, wherein said first conductivity type is opposite said second conductivity type; and neutralizing said electrostatic charge having said first conductivity and said electrostatic charge having said second conductivity type to separate said document sheet from said inner surface of said top cover.

21. The method according to claim 20, wherein said generating said electrostatic charge with said first conductivity and said electrostatic charge with said second conductivity is an electrostatic generating device.

22. The method according to claim 20, wherein said generating said electrostatic charge with said first conductivity type and said second conductivity type is controlled by pressing a button element on a top cover to transmit a signal to said electrostatic generating device.

23. A computer-readable medium having stored thereon instructions to cause a computer to execute a method, the method comprising:

providing a document sheet on a transparent plate of an image-inputting device;

generating and transmitting an electrostatic charge with a first conductivity type to an inner surface of a top cover;

generating static electricity to said inner surface of said top cover;

adsorbing said document sheet on said transparent platen by using said electrostatic charge with said first conductivity type that spread over said inner surface of said top cover;

generating and transmitting an electrostatic charge with a second conductivity type to said inner surface of said top cover, wherein said first conductivity type is opposite said second conductivity type; and neutralizing said electrostatic charge having said first conductivity and said electrostatic charge having said second conductivity type to separate said document sheet from said inner surface of said top cover.

* * * * *

UNITED STATES PATENT AND TRADEMARK OFFICE

CERTIFICATE OF CORRECTION

PATENT NO. : 6,965,749 B2
DATED : November 15, 2005
INVENTOR(S) : Shih Yang Lee

It is certified that error appears in the above-identified patent and that said Letters Patent is hereby corrected as shown below:

Column 5,
Lines 59-62, change "generates said electrostatic charge, and transmit to a thin slice, which is under said inner surface of the top cover through an electric wire to adsorb said document sheet located on said transparent platen" to -- is used to generate the electrostatic charge, and transmit to an inner surface of said top cover to adsorb a document sheet located on said transparent platen --.

Signed and Sealed this

Seventh Day of February, 2006

JON W. DUDAS
*Director of the United States Patent and Trademark Office*